United States Patent [19]

Nakajima

[11] Patent Number: 5,017,097

[45] Date of Patent: May 21, 1991

[54] CONTROL VALVE DEVICE FOR VARIABLE CAPACITY COMPRESSORS

[75] Inventor: Nobuyuki Nakajima, Konan, Japan

[73] Assignee: Diesel Kiki Co., Ltd., Tokyo, Japan

[21] Appl. No.: 471,510

[22] Filed: Jan. 29, 1990

[30] Foreign Application Priority Data

Jan. 30, 1989 [JP] Japan ..... 1-20565

[51] Int. Cl.[5] ..... F04B 49/00

[52] U.S. Cl. ..... 417/295; 417/310

[58] Field of Search ..... 417/295, 310

[56] References Cited

U.S. PATENT DOCUMENTS

| | | | |
|---|---|---|---|
| 4,744,732 | 5/1988 | Nakajima | 417/295 |
| 4,865,524 | 9/1989 | Nakajima | 417/295 |
| 4,929,156 | 5/1990 | Eitai | 417/310 |

*Primary Examiner*—Michael Koczo
*Assistant Examiner*—Alfred Basichas
*Attorney, Agent, or Firm*—Charles S. McGuire

[57] ABSTRACT

A variable capacity compressor includes a control element for determining timing of start of compression of a refrigerant gas. Control pressure which prevails in a high-pressure chamber acts on the control element. The high-pressure chamber communicates with a suction chamber via a communicating passage, across which is arranged a control valve device for opening and closing the communicating passage to change the control pressure within the high-pressure chamber. The control valve device comprises a valve body, a spring urging the valve body in a closing direction, and a bellows expansible and contractible in direct response to suction pressure within the suction chamber for urging the valve body in an opening direction against the force of the spring when it is expanded. A high pressure-introducing passage has one end opening into a space within which discharge pressure prevails and another end facing the valve body, the discharge pressure from the space prevailing within the high pressure-introducing passage. A plunger is slidably fitted in the high pressure-introducing passage and projects out of the other end thereof. The plunger is responsive to the discharge pressure within the high pressure-introducing passage to urge the valve body in a closing direction.

4 Claims, 7 Drawing Sheets

CONTROL VALVE DEVICE FOR VARIABLE CAPACITY COMPRESSORS

BACKGROUND OF THE INVENTION

This invention relates to a control valve device for controlling the timing of start of compression of a variable capacity compressor which compresses a refrigerant gas circulating in an air-conditioning system for an automotive vehicle.

A conventional control valve device of this type is disclosed in U.S. Pat. No. 4,865,524 (corresponding to DE-OS No. 39 04 984) by the present assignee.

In this patent, as shown in FIG. 1, 1 there is disclosed a variable capacity vane compressor comprising a control element 70 disposed to rotate between the minimum capacity position and the maximum capacity position for controlling the timing of start of compression, a first pressure chamber (a low pressure chamber) 71 which is formed on one side of a pressure-receiving protuberance 70*a* on the control element 70 and into which is introduced suction pressure Ps as low pressure, a second pressure chamber (a high pressure chamber) 73 formed on the other side of the pressure-receiving protuberance 70*a* and into which is introduced discharge pressure Pd as high pressure via a restriction passage 72 to create control pressure Pc therein, and a control valve device 75 for controlling the control pressure Pc by opening and closing a passage 79 and extending between the the second pressure chamber 73 and a suction chamber 74 in response to change in the suction pressure dependent on thermal load, wherein the control element 70 is rotated in response to difference between the sum of the suction pressure Ps introduced into the first pressure chamber 71 and the urging force of a coiled spring 76 urging the control element 70 toward the minimum capacity position, and the control pressure Pc, to thereby control the capacity of the compressor.

As shown in FIGS. 1 and 2, the compressor is provided with an auxilary low-pressure chamber 78 which is separated from the suction chamber 74 by a wall 80 having a restriction through hole 77 formed therethrough and communicating the auxiliary low-pressure chamber 78 with the suction chamber 74, and bellows 75*a* as a pressure-responsive deformable means of the control valve device 75 is arranged within the auxiliary low-pressure chamber 78. By virtue of this construction, the suction pressure Ps is controlled such that it increases with decrease in the discharge pressure Pd as shown in FIG. 9, in order that the pressure of the refrigerant gas at the outlet of the evaporator may be substantially kept constant irrespective of change in the thermal load on the air conditioning system, thereby preventing freeze-up of the outlet of the evaporator.

More specifically, according to this variable capacity compressor, when the bellows 75*a* expands in response to decrease in the auxiliary low pressure Ps' to open the valve of the control valve device 75, the refrigerant gas under the control pressure Pc flows from the second pressure chamber 73 via the passage 79 into the auxiliary low-pressure chamber 78. The refrigerant gas then flows through the restriction through hole 77 into the suction chamber 74, whereby the control pressure Pc within the second pressure chamber 73 lowers to a value lower than the sum of the suction pressure Ps within the first pressure chamber 71 and the urging force of the coiled spring 76, so that the control element 70 is rotated from the maximum capacity position toward the minimum capacity position.

However, as shown in FIGS. 1 and 2, the bellows 75*a* is arranged within the auxiliary low-pressure chamber 78 such that when the valve becomes open, the refrigerant gas under the control pressure PC passes an end $75a_1$ of the bellows 75*a*, and a corrugated peripheral wall $75a_2$ of same, to the vicinity of the other end $75a_3$ of same to be drawn into the suction chamber 74. On this occasion, the refrigerant gas hits against the corrugated peripheral wall $75a_2$ to cause a slight vibration of the bellows 75*a*, which in turn hits against the inner peripheral wall of the auxiliary low-pressure chamber 78. This results in offensive noise, degraded capacity control of the variable capacity compressor as well as a shortened life of the bellows.

SUMMARY OF THE INVENTION

It is the object of the invention to provide a control valve device for a variable capacity compressor, which is capable of preventing occurrence of offensive noise due to vibration of the bellows when the control valve device is brought into an open state, improving the capacity controllability of the compressor, and prolonging the life of the belllows.

To attain the above object, the present invention provides a variable capacity compressor including a suction chamber, a space within which discharge pressure prevails, a control element for determining timing of start of compression of a refrigerant gas, the control element having a pressure-receiving portion, a high-pressure chamber defined by the pressure-receiving portion and within which control pressure prevails and acts on the pressure-receiving portion of the control element, a communicating passage communicating the high-pressure chamber with the suction chamber, and a control valve device for opening and closing the communicating passage to change the control pressure within the high-pressure chamber, the control valve device including a valve body disposed to open and close the communicating passage, a spring urging the valve body in a closing direction, and a bellows expansible and contractible in direct response to suction pressure within the suction chamber for urging the valve body in an opening direction against the force of the spring when it is expanded. The variable capacity compressor according to the invention is characterized by comprising a high pressure-introducing passage which has one end opening into the space and another end facing the valve body, the discharge pressure from the space prevailing within the high pressure-introducing passage, and a plunger slidably fitted in the high pressure-introducing passage and projecting out of another end thereof, the plunger being responsive to the discharge pressure within the high pressure-introducing passage for urging the valve body in a closing direction.

According to the control valve device of the present invention, since the bellows is arranged in direct communication with the suction chamber instead of being arranged within the auxiliary low-pressure chamber 33, the refrigerant gas flowing from the high pressure chamber smoothly passes through the communication passage into the suction chamber when the bellows expands to open the valve of the control valve device, so that the bellows does not suffer from a slight vibration.

Further, since the high pressure-introducing passage is provided to directly apply the discharge pressure to the plunger, the plunger operates more smoothly.

In one form of the invention, the variable capaciaty compressor includes a cam ring and at least one side block cooperating to form a cylinder, the at least one side block having a second space formed therein and accommodating the valve body, and at least one discharge valve mounted on the cam ring, the space being a valve chamber accommodating the at least one discharge valve, the high pressure-introducing passage comprising a first passage formed in the cam ring and having one end opening into the valve chamber and another end opening in an end face of the cam ring facing the at least one side block, a second passage formed in the at least one side block and having one end opening in an end face of the at least one side block facing the cam ring, and a third passage having one end communicating with another end of the second passage and another end opening into the second space.

Preferably, the valve body comprises a ball valve body, the ball valve body having a seating area substantially equal to an area of an end face of the plunger facing the ball valve body.

The above and other objects, features and advantages of the invention will become more appparent from the ensuing detailed description taken in conjunction with the accompanying drawings.

DETAILED DESCRIPTION

The invention will now be described in detail with reference to the drawings, showing an embodiment thereof.

Figure 1:
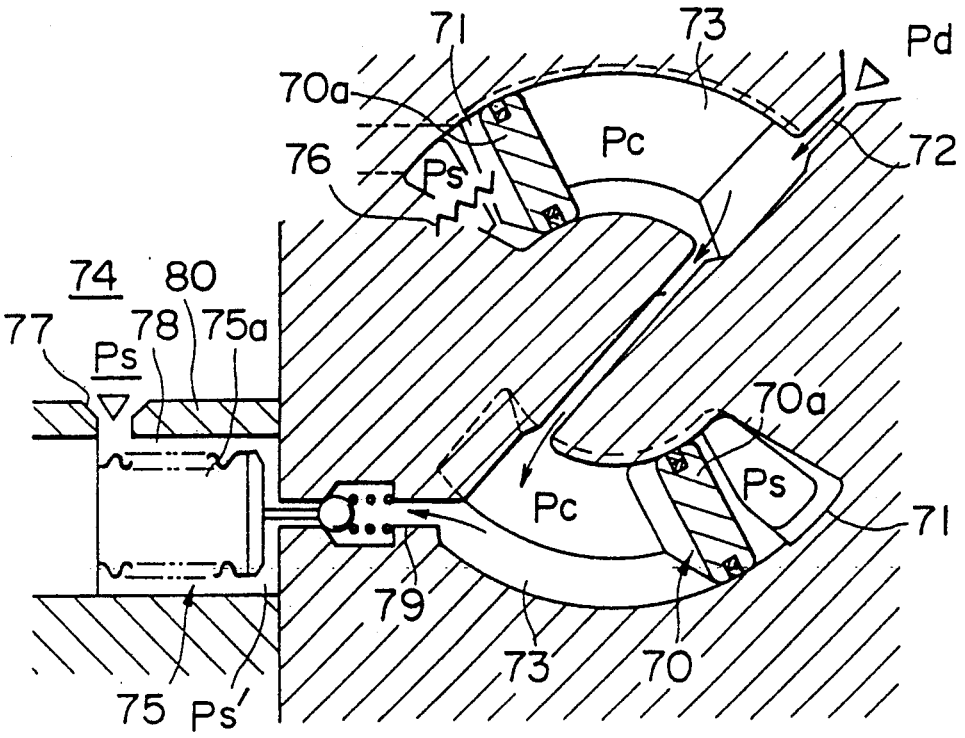
FIG. 1 PRIOR ART
FIG. 1 is a diagrammatic view showing essential parts of a capacity control section of a conventional variable capacity vane compressor.
Figure 2:
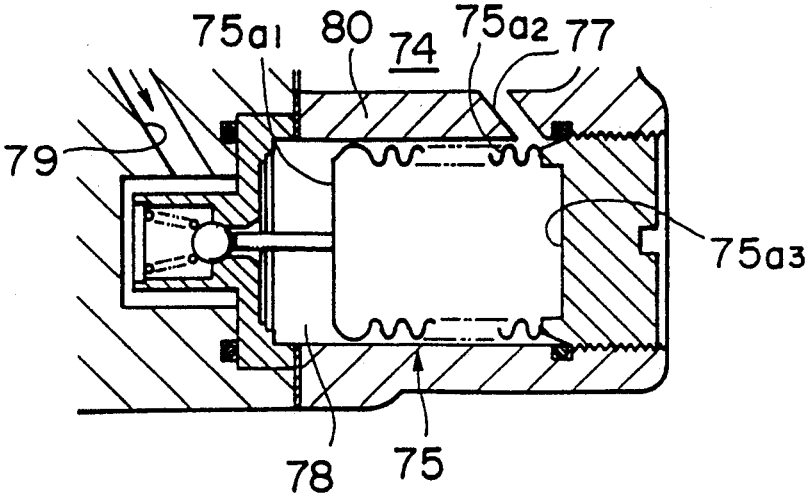
FIG. 2 PRIOR ART
FIG. 2 is an enlarged longitudinal cross-sectional view showing a control valve device of the conventional variable capacity vane compressor.
Figure 3:
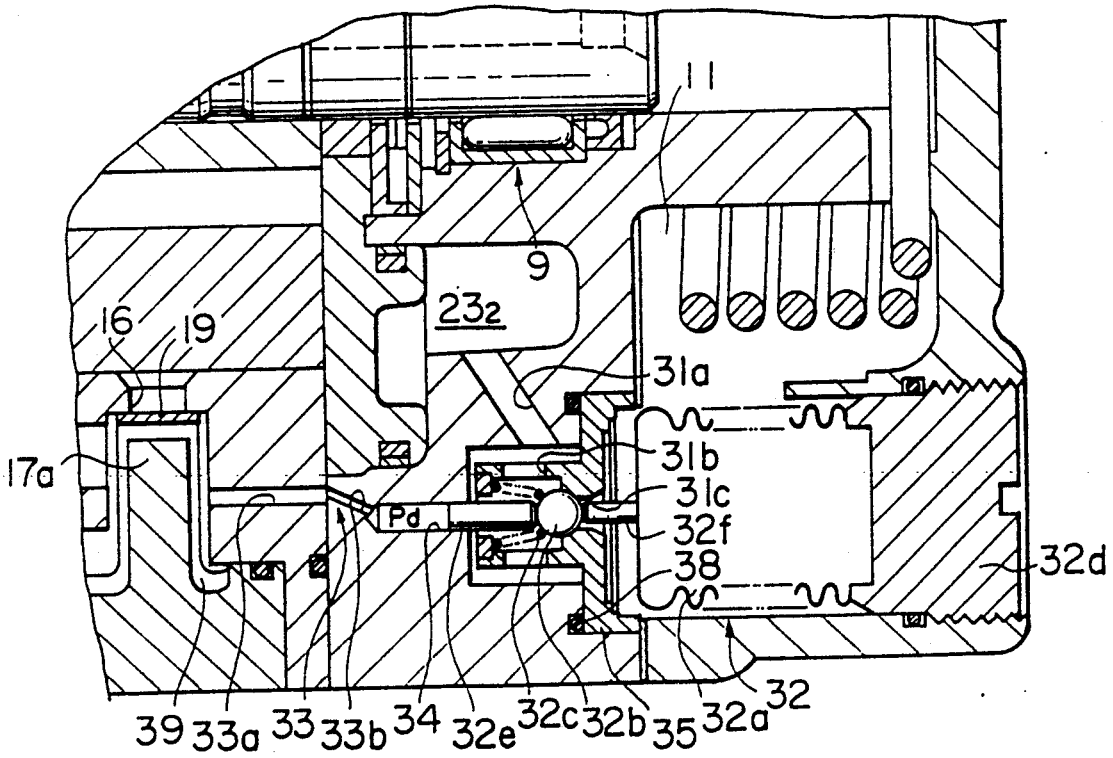
FIG. 3 is a fragmentary cross-sectional view showing one embodiment of a control valve device according to the present invention.
Figure 4:
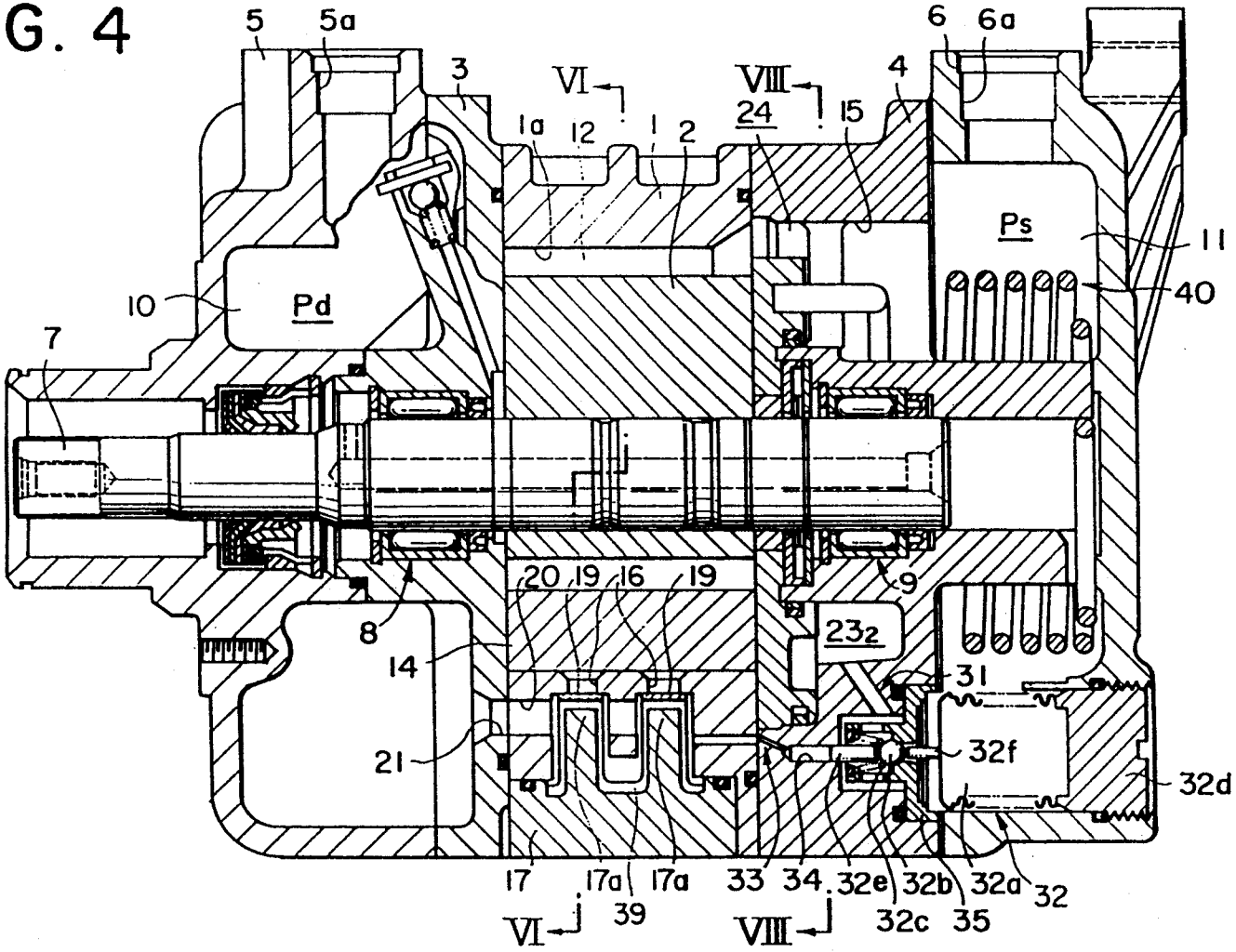
FIG. 4 is a longitudinal cross-sectional view of a variable capacity vane compressor equipped with the control valve device appearing in FIG. 3.

FIG. 3 shows a control valve device according to the embodiment of the invention, and FIG. 4 shows a variable capacity vane compressor equipped with the control valve device.

Figure 6:
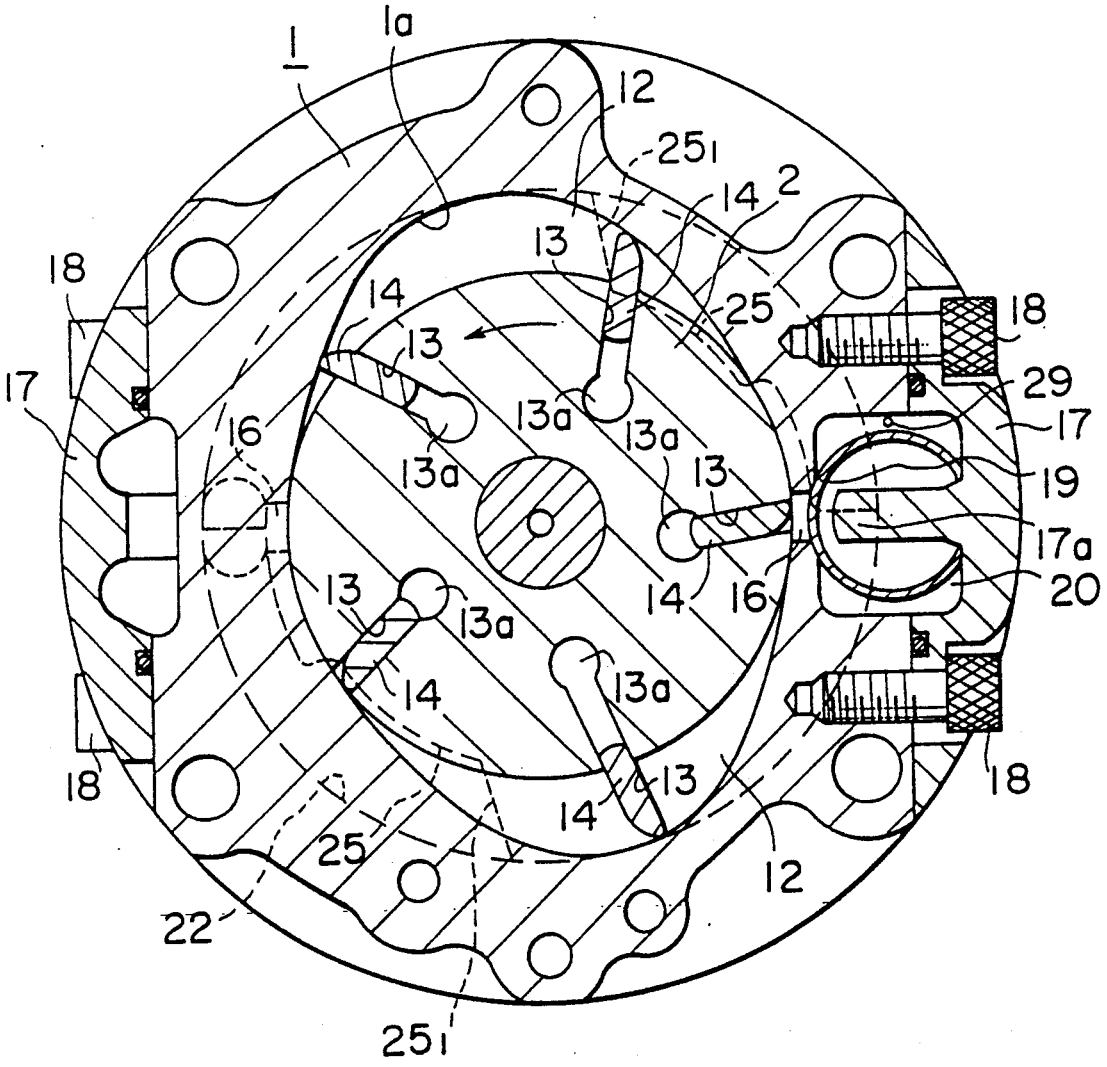
FIG. 6 is a transverse cross-sectional view taken along line VI—VI of FIG. 4, showing a control element in the maximum capacity position.

Referring to FIG. 4 and 6, the variable capacity vane compressor is composed mainly of a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

A pair of compression spaces 12, 12 are defined at diametrically opposite locations between the inner peripheral surface 1*a* of the cam ring 1, the outer peripheral surface of the rotor 2, and end face of the front side block 3 on the cam ring 1 side, and an end face of a control element 24 on the cam ring 1 side. The rotor 2 has its outer peripheral surface formed therein with a plurality of axial vane slits 13 at circumferentially equal intervals, in each of which a vane is radially slidably fitted.

A bottom portion of eahc vane slit 13 and a corresponding vane 14 cooperate to define a back pressure chamber 13*a*, into which is introduced vane back pressure from the compression space 12 through between one end face of the rotor 2 and a rotor side end face of the front side block 3, and through between the other end face of the rotor 2 and a rotor side end face of the control element.

When the rotor 2 rotates, the front edge of the vane 14 slides along the generally elliptical peripheral surface 1*a* of the cam ring 1.

Refrigerant inlet ports 15, 15 are formed in the rear side block 4 at diametrically opposite locations, as shown in FIG. 4 (since FIG. 4 shows a cross-section taken at an angle of 90° formed about the longitudinal axis of the compressor, only one refrigerant inlet port is shown in the figure.) These refrigerant inlet ports 15 axially extend through the rear side block 4, and through which the suction chamber 11 and the compression spaces 12 are communicated with each other.

Refrigerant outlet ports 16, 16 each having two openings, are formed through opposite lateral side walls of the cam ring 1 at diametrically opposite locations. (In FIG. 4, for the same reason as in the case of the refrigerant inlet ports, only one of the refrigerant outlet ports is shown.). To each of the opposite lateral side walls of the cam ring 1 is secured by a bolt 18 a discharge valve cover 17 having a valve stopper 17*a*. Defined between the lateral side wall and the valve stopper 17*a* is a valve chamber 39 in which is disposed a discharge valve 19 retained on the discharge valve cover 17. Each discharge valve 19 opens in response to discharge pressure to thereby open the corresponding refrigerant outlet port 16. Further defined by the cam ring 1 and the discharge valve covers 17 are a pair of passages 20 which each communicate with a corresponding one of the refrigerant outlet ports 16 via a corresponding one of the valve chambers 39 when the discharge valve 19 opens. A pair of passages 21 are formed in the front side block 3 at diametrically opposite locations thereof, which each communicate with a corresponding one of the passages 20, whereby when the discharge valve 19 opens to thereby open the refrigerant outlet port 16, a compressed refrigerant gas in the compression space 12 is discharged from the discharge port 5*a* via the refrigerant outlet port 16, the passages 20 and 21, and the discharge pressure chamber 10, in the mentioned order.

Figure 8:
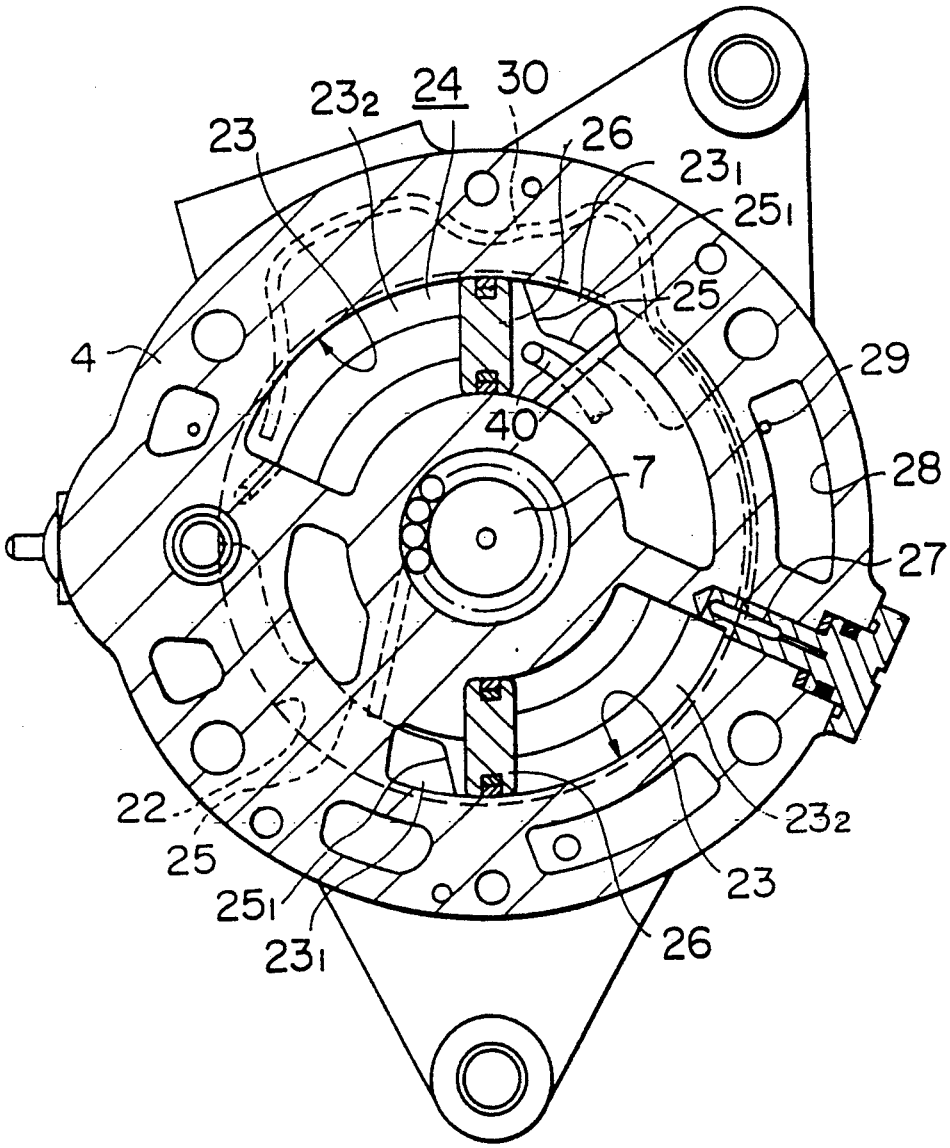
FIG. 8 is a transverse cross-sectional view taken along line VIII—VIII of FIG. 4.

As shown in FIGS. 4 and 8, the rear side block 4 has an end face facing the rotor 2, in which is formed an annular recess 22. A pair of pressure working chambers 22, 23 are formed in a bottom of the annular recess 22 at diametrically opposite locations. A control element 24, which is in the form of an annulus, is received in the annular recess 22 for rotation about its own axis in opposite circumferential directions. The control element 24 controls the timing of start of compression of the compressor, and has its outer peripheral edge formed with a pair of diametrically opposite arcuate cut-out portion 25, 25, and its one side surface formed integrally with a pair of diametrically opposite pressure-receiving protuberances 26, 26 axially projected therefrom and acting as pressure-receiving elements. The pressure-receiving protuberances 26, 26 are slidably received in respective pressure working cahmbers 23, 23. The interior of each pressure working chamber 23 is divided into a low-pressure chamber $23_1$ and a high-pressure chamber $23_2$ by the associated pressure-receiving protuberance 26. Each low-pressure chamber $23_1$ communicates with the suction chamber 11 through the corresponding refrigerant inlet port 15 to be supplied with the refrigerant gas under suction pressure Ps or low pressure.

In the meanwhile, one of the high-pressure chambers $23_2$, $23_2$ communicates with the corresponding passage 20 via an orifice 27, a communicating groove, not shown, in the rear head 6, which communicates with the orifice 27, a communicating passage 28 in the rear side block 4, which communicates with the communicating groove, and a control pressure-supplying port 29 in the cam ring 1. These high-pressure chambers $23_2$, $23_2$ are communicated with each other by way of a passage 30 formed in the rear head 6 so that discharge pressure Pd is supplied into the both chamber $23_2$, $23_2$ via the orifice 27 to create control pressure Pc.

As shown in FIG. 4, one of the high-pressure chambers $23_2$, $23_2$ is communicatable with the suction chamber 11 via a passage 31. As shown in FIG. 3, the passage 31 consists of a passage 31*a* formed in the rear side block 4, and passages 31*b* and 31*c* formed in a casing 35 of bellows 32*a*. A control valve device 32 is arranged across the passage 31.

The control valve device 32 is operable in response to the suction pressure Ps prevailing within the suction chamber 11. The device 32 comprises a ball valve body 32*b* for opening and closing the passage 31 extending between the suction chamber 11 and the high-pressure chamber $23_2$ into which discharge pressure (high pressure) Pd is introduced, a coiled spring 32*c* urging the ball valve body 32*b* in its closing direction, a plunger 32*e* responsive to discharge pressure Pd introduced from the valve chamber 39 for urging the ball valve body 32*b* in its closing direction, a bellows 32*a* expansible and contractible in response to change in the suction pressure prevailing in the suction chamber 11, a rod 32*f* fixed to a free end of the bellows 32*a* for urging the ball valve body 32*b* in its opening direction, and a high pressure-introducing passage 33 for directly introducing discharge pressure Pd from the valve chamber 39 and applying same to the plunger 32*e*.

The rod 32*f* is movably inserted in the passage 31*c* formed in the casing 35, and its tip abuts against the ball valve body 32*b*. The plunger 32*e* is slidably arranged in a bore 34 formed in the rear side block 4. The discharge pressure Pd is directly introduced into the bore 34 via the high pressure-introducing passage 33 without being restricted in flow rate to act on one end face of the plunger 32*e*, which in turn positively urges the ball valve 32*b* in its closing direction. It should be noted that since the other end face of the plunger 32*e* receives the control pressure Pc introduced from the high-pressure chamber $23_2$, the plunger 32*e* operates in response to the difference $\Delta P$ between the discharge pressure Pd and the control pressure Pc. The high pressure-introducing passage 33 comprises a first passage 33*a* formed in the cam ring 1 and opening into the valve chamber 39, and a second passage 33*b* formed in the rear side block 4 and extending continuously from the first passage 33*a* to the bore 31. The bore 34 also forms part of the high pressure-introduced passage 33. Therefore, the discharge pressure Pd is directly applied to the plunger 32*c* through the passage 33 without being restricted in flow rate, so that the correction of the suction pressure Ps, described later, can be positively effected. A valve seating portion 31*d* at an end of the passage 31*c*, the ball valve body 32*b* and the plunger 32*e* are sized such that the seating area of the ball valve body 32*b* on the valve seating portion 31*d* and the area S of the end face (corresponding to the pressure-receiving surface of the ball valve body) of the plunger 32*e* facing the ball valve body 32*b* are substantially equal to each other. When the pressure Ps in the suction chamber 11 is above a predetermined value which is set by an adjusting member 32*d* (it should be noted that the predetermined value is also determined by and varies with the discharge pressure Pd applied to the plunger 32*e* as described hereinafter), the bellows 32*a* is in its contracted state, so that the urging force by the coiled spring 32*c* and the plunger 32*e* causes the ball valve body 32*b* to block the passage 31*c*. In the meanwhile, when the pressure Ps in the suction chamber 11 is lower than the predetermined value, the bellows 32*a* is expanded, so that the rod 32*f* fixed to the free end thereof moves the ball valve body 32*b*, against the urging force by the coiled spring 32*c* and the plunger 32*e*, to open the passage 31*c*. An O ring 38 is interposed between the casing 35 and the rear side block 4.

Figure 7:
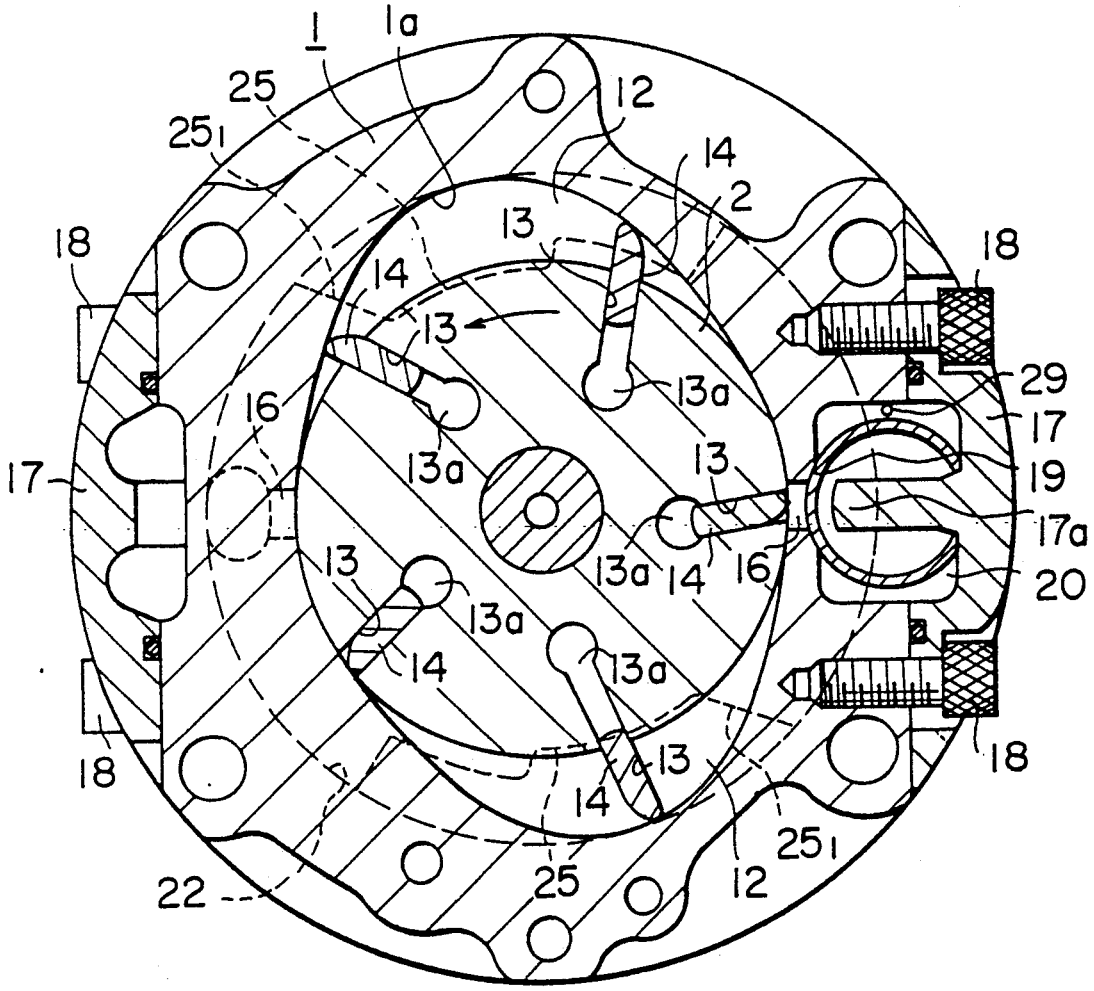
FIG. 7 is a view similar to FIG. 6, showing the control element in the minimum capacity position.

Further, the control element 24 is urged toward the minimum capacity position as shown in FIG. 7 by a torsion coiled spring 40 fitted around a hub of the rear side block 4 axially extending into the suction chamber 11. Thus, the control element 24 is rotatable in opposite directions in response to the difference between the sum of the suction pressure Ps introduced into the low-pressure chambers $23_1$ and the urging force of the coiled spring 40, and the control pressure Pc within the high-pressure chambers $23_2$. To be specific, the control pressure Pc within the high-pressure chamber $23_2$ is controlled by means of the control valve device 32 so as to maintain the suction pressure Ps at the predetermined value so that the control element 24 is rotated in opposite directions between two extreme positions, i.e. the maximum capacity position for obtaining the maximum delivery quantity or capacity of the compressor as shown in FIG. 6, and the minimum capacity position for obtaining the minimum delivery quantity or capacity of the compressor as shown in FIG. 7.

The operation of the compressor constructed as above will now be explained.

When the suction pressure Ps rises above a predetermined value in accordance with increase in thermal load, the bellows 32*a* of the control valve device 32 is contracted to close the passage 31 (the state as shown in FIG. 3). (It should be noted that the predetermined value varies with the discharge pressure Pd applied to the plunger 32*e*.) Consequently, the control pressure Pc within the high-pressure chambers $23_2$ is maintained at a high level, so that the control pressure Pc overcomes the sum of the pressure Ps within the low-pressure chambers $23_1$ and the urging force of the torsion coiled spring 40, to thereby rotate the control element 24 toward the maximum capacity position as shown in FIG. 6. In the maximum capacity position, the control element 24 assumes such a position that a downstream end $25_1$ of the cut-out portion 25 thereof with respect to the rotational direction (the counter-clockwise direction as viewed in FIG. 6) of the rotor 2 is in an extreme upstream position, i.e. an extreme clockwise position of the control element 27, whereby the compression stroke commences at the earliest timing. Therefore, the volume of the refrigerant gas trapped within the compression chamber defined between the two successive vanes is the maximum, resulting in the maximum delivery quantity or capacity of the compressor.

On the other hand, when the suction pressure Ps falls below the predetermined value, the bellows 32*a* of the control valve device 32 is expanded to open the passage 31. Consequently, the refrigerant gas with the control pressure Pc flows from the high-pressure chamber $23_2$ through the passage 31 into the suction chamber 11, so that the control pressure Pc within the high-pressure chambers $23_2$ decreases below the sum of the pressure Ps within the low-pressure chambers $23_1$ and the urging force of the coiled spring 40, thereby rotating the control element 24 from the aforementiond maximum capacity position toward the minimum capacity position as shown in FIG. 7. In the minimum capacity position, the central element assumes such a position that the downstream end $25_1$ of each cut-out portion 25 is in an extreme downstream position, whereby the compression stroke commences at the most retarded timing. Therefore, the volume of the refrigerant gas trapped within the compression chamber defined between the two successive vanes is the minimum, resulting in the minimum delivery quantity or capacity or the compressor.

Now, the operation of the control valve device 32 will be described.

Figure 5:
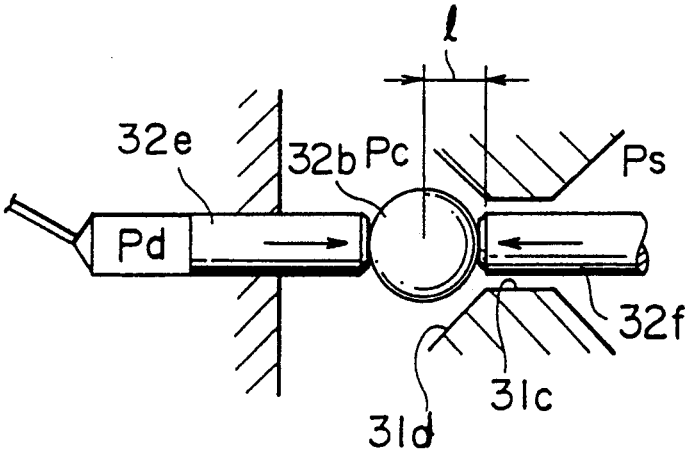
FIG. 5 is a schematic cross-sectional view showing essential parts of the control valve device in an open state.
Figure 9:
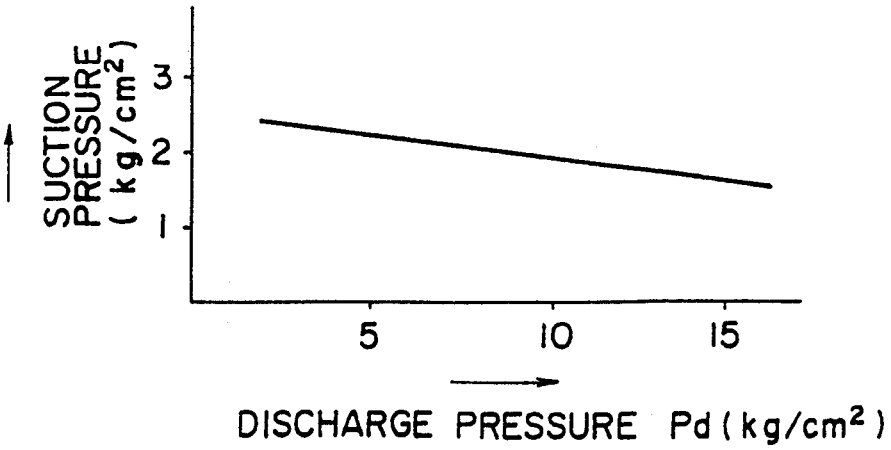
FIG. 9 is a graph useful in explaining the relationship between suction pressure and discharge pressure.

When the capacity of the compressor is the maximum, the control pressure Pc and the discharge pressure Pd are substantially equal to each other. Therefore, the force F ($F=S(Pd-Pc)$) of the plunger 32*e* acting on the ball valve body 32*b* is substantially zero. When the capacity of the compressor varies toward the minimum, the suction pressure Ps is lowered, so that the ball valve body is lifted by a distance l as shown in FIG. 5, and the control pressure Pc is decreased to increase the force F. In the minimum capacity position of the control element 24, the control pressure Pc and the suction pressure Ps are in the relationship of $Ps<Pc<Ps+3$ kg/cm$^2$. On this occasion, as the discharge pressure Pd is higher, the difference $\Delta P$ ($\Delta P=Pd-Pc$) is greater, so that the force F is greater, which results in a shortened lift l of the ball valve body 32*b*. As a result, the flow rate of the refrigerant gas flowing from the high-pressure chamber $23_2$ into the suction chamber 11 is reduced, to thereby rotate the control element 24 toward the maximum capacity position by a small degree. More specifically, assuming that if the discharge pressure Pd is 14 kg/cm$_2$, the suction pressure Ps is 1.8 kg/cm$^2$, if the discharge pressure Pd is 18 kg/cm$^2$, the suction pressure Ps will be controlled to 1.6 kg/cm$^2$. On the contrary, if the discharge pressure Pd is as low as 7 kg/cm$^2$, the suction pressure Ps will be controlled to 2.2 kg/cm$^2$. In this way, as shown in FIG. 9, as the discharge pressure Pd is higher, the force F is greater and the suction pressure Ps is controlled to a smaller value, whereas the discharge pressure Pd is lower, the force F is smaller and the suction pressure Ps is controlled to a higher value.

Suppose that the bellows 32*a* having a bellows stroke change rate of 1 mm/1 kg/cm$^2$ and a spring constant of 1.6 kg/mm is used. If the desired correction rate (the slope of a straight line in FIG. 9) of the suction pressure Ps per unit change of 1 kg/cm$^2$ in the discharge pressure Pd applied to the plunger 32*e* is set at 0.06 kg/cm$^2$, for example, the required correction amount of the bellows stroke is as follows:

$$0.06\ \text{kg/cm}^2 \times 1\ \text{mm/kg/cm}^2 = 0.06\ \text{mm}$$

Therefore, the force for correcting the bellows stroke to be obtained by the plunger 32*e* is as follows:

$$0.06\ \text{mm} \times 1.6\ \text{kg/mm} = 0.096\ \text{kg}$$

This force corresponds to a pressure-receiving area of 0.096 cm$^2$ of the plunger 32*e* receiving a unit pressure variation of 1 kg/cm$^2$ derived from the discharge pressure Pd applied to the plunger 32*e*. Therefore, the radius r of the plunger 32*e* should be as follows:

$$0.096\ \text{cm}^2 = \pi r^2$$

$$r = 0.175\ \text{cm}$$

Therefore, the required diameter of the plunger 32*e* is 0.35 cm.

As the valve body of the control valve device 32, a needle may be used in place of the ball valve body 32*b*.

As described above, according to the control valve device for the variable capacity compressor of the invention, the correction of the suction pressure Ps is effected by the plunger responsive to the discharge pressure Pd which is directly applied to the plunger without being restricted. The bellows is arranged in the suction chamber, instead of the auxiliary low-pressure chamber as in the conventional compressor. Therefore, refrigerant gas under the control pressure flowing from the high-pressure chamber smoothly passes into the suction chamber, without causing vibrations of the bellows, when the bellows is expanded to open the control valve device. Consequently, no offensive noise is produced, and the capacity controllability of the compressor can be improved, and the life of the bellows can be prolonged.

What is claimed is:

1. In a variable capacity compressor including a suction chamber, a space within which discharge pressure prevails, a control element for determining timing of start of compression of a refrigerant gas, said control element having a pressure-receiving portion, a high-pressure chamber defined by said pressure-receiving portion and within which control pressure prevails and acts on said pressure-receiving portion of said control element, a communicating passage communicating said high-pressure chamber with said suction chamber, and a control valve device for opening and closing said communicating passage to change said control pressure within said high-pressure chamber, said control valve device including a valve body disposed to open and close said communicating passage, a spring urging said valve body in a closing direction, and a bellows expansible and contractible in direct response to suction pressure within said suction chamber for urging said valve body in an opening direction against the force of said spring when it is expanded, the improvement comprising:

a high pressure-introducing passage which has one end opening into said space and another end facing said valve body, said discharge pressure from said space prevailing within said high pressure-introducing passage; and a plunger slidably fitted in said high pressure-introducing passage and projecting out of said another end thereof, said plunger being responsive to said discharge pressure within said high pressure-introducing passage for urging said valve body in a closing direction.

2. A variable capacity compressor as claimed in claim 1, including a cam ring and at least one side block cooperating to form a cylinder, said at least one side block having a second space formed therein and accommodating said valve body, and at least one discharge valve mounted on said cam ring, said space being a valve chamber accommodating said at least one discharge valve, said high pressure-introducing passage comprising a first passage formed in said cam ring and having one end opening into said valve chamber and another end opening in an end face of said cam ring facing said at least one side block, a second passage formed in said at least one side block and having one end opening in an end face of said at least one side block facing said cam ring, and a third passage having one end communicating with another end of said second passage and another end opening into said second space.

3. A variable capacity compressor as claimed in claim 1, wherein said valve body comprises a ball valve body, said ball valve body having a seating area substantially equal to an area of an end face of said plunger facing said ball valve body.

4. A variable capacity compressor as claimed in claim 1, wherein said bellows is arranged within said suction chamber.

* * * * *